United States Patent [19]

Ross

[11] Patent Number: 4,776,622

[45] Date of Patent: Oct. 11, 1988

[54] BOTTLE CARRIER

[76] Inventor: Robert J. Ross, 485 Coates Ave., Holbrook, N.Y. 11741

[21] Appl. No.: 77,668

[22] Filed: Jul. 24, 1987

[51] Int. Cl.[4] ..... B65D 71/04

[52] U.S. Cl. ..... 294/87.2; 206/150

[58] Field of Search ..... 294/87.2, 37.2, 27.1, 294/170, 145, 164, 87.28, 169; 215/100 A; 206/150, 151, 152, 153, 158, 161, 199, 427; 220/94 R

[56] References Cited

U.S. PATENT DOCUMENTS 3,167,347 1/1965 Hewlings ..... 294/87.2

4,544,194 10/1985 Allen ..... 294/87.2

4,666,203 5/1987 Castro ..... 294/170

*Primary Examiner*—James B. Marbert

*Attorney, Agent, or Firm*—Richard L. Miller

[57] ABSTRACT

This bottle carrier device is designed to enable a user to comfortably carry a plurality of beverage bottles back to a store when empty. Primarily, it consists of a pair of slotted racks connected in the middle by a carry handle, and the slots in the racks are tapered towards the ends of the racks, for entry of the empty bottles and supporting them by the flange portion on the necks of the beverage bottles.

4 Claims, 1 Drawing Sheet

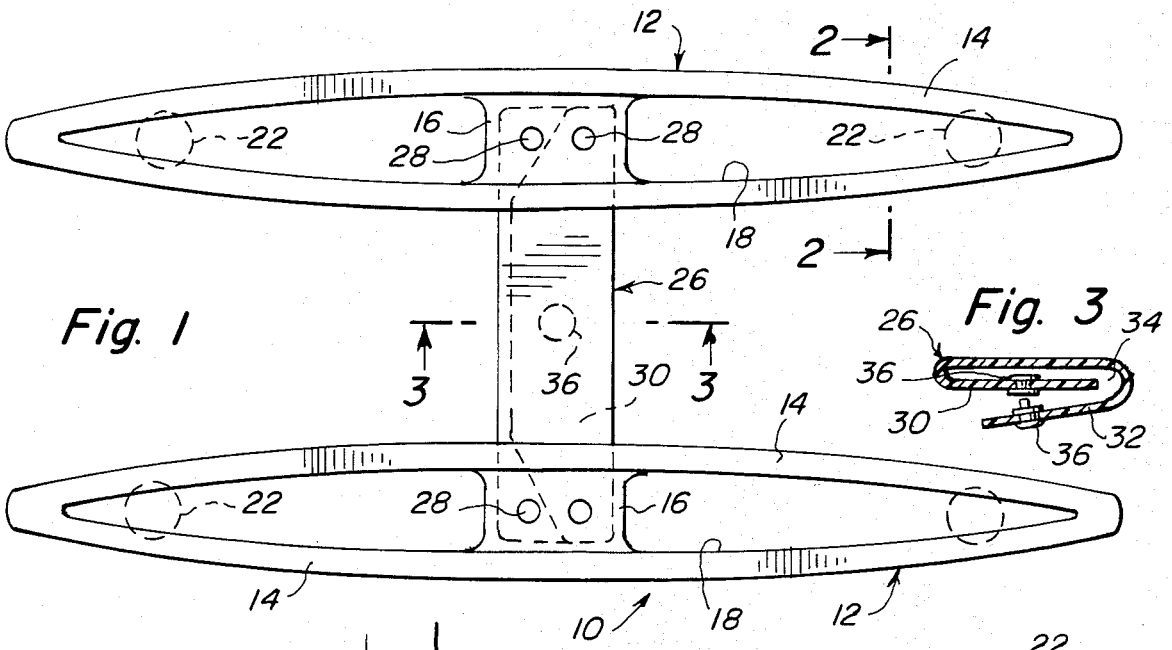
Fig. 1
Fig. 3
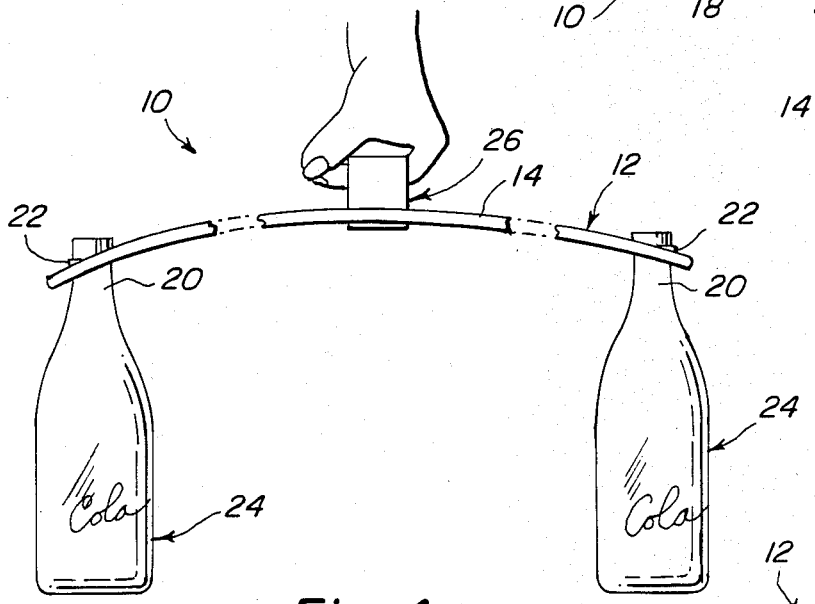
Fig. 4
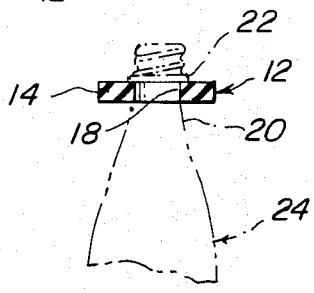
Fig. 2
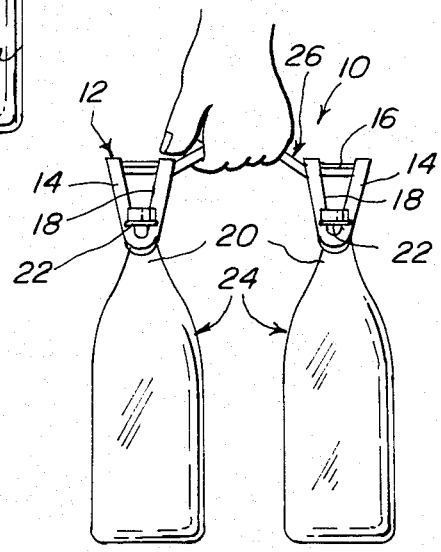
Fig. 5
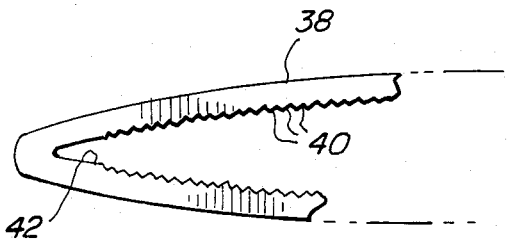
Fig. 6

BOTTLE CARRIER

BACKGROUND OF THE INVENTION

The instant invention relates generally to devices for supporting and carrying articles, and more particularly, to a bottle carrier.

Numerous devices have been provided in the prior art that are adapted to carry bottles. For example, U.S. patents numbered U.S. Pat. No. 2,420,191 of Ranson, U.S. Pat. No. 2,426,750 of Reutner, and U.S. Pat. No. 2,616,751 of Goldenberg, all are illustrative of such prior art. While these units may be suitable for the particular purpose to which they address, they would not be as suitable for the purpose of the present invention as hereafter described.

SUMMARY OF THE INVENTION

A primary object of the present invention is to provide a bottle carrier that will overcome the shortcomings of the prior art devices.

Another object is to provide a bottle carrier that will be of such design, as to carry a plurality of empty beverages bottles back to super markets and the like, without the employment of a bag, etc.

An additional object is to provide a bottle carrier that will be of such structure, that it will be carried in one hand comfortably.

Yet an additional object is to provide a bottle carrier that also provides a change purse compartment.

A further object is to provide a bottle carrier that is simple and easy to use.

A still further object is to provide a bottle carrier that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a top view of the invention, showing in phantom some bottles being carried therein.

FIG. 2 is a cross sectional view on line 2—2 of FIG. 1.

FIG. 3 is a cross sectional view taken on line 3—3 of FIG. 1, and showing an optional pocket inside the handle in which money or a shopping list can be carried.

FIG. 4 is a side elevational view showing some bottles being carried in the carrier.

FIG. 5 is an end elevational view thereof.

FIG. 6 is a fragmentary top plan view showing a modified construction wherein the slot is toothed so as to better grip the neck of a bottle.

DETAILED DESCRIPTION OF THE PREFERRED EMBODIMENTS

Turning now descriptively to the drawings, in which like reference characters denote like elements throughout the several views, a device 10 is shown to include a frame 12 composed of a pair of parallel spaced racks 14 that taper towards both ends. A center member 16 is fixedly secured between the longitudinal side portions of racks 14, and defines a pair of openings 18, that also taper towards the ends of racks 14 for receiving the neck portions 20 beneath the upper flanges 22 of bottles 24, and the flanges 22 engage with the top of the racks 14, enabling the bottles 24 to depend downward from device 10.

A flexible handle 26 is provided and is secured fixedly to center members 16 by suitable fasteners 28, and an optional pocket is provide in handle 26 and includes overlapping flaps 30 and 32 that define a compartment 34, and flaps 30 and 32 include snap fasteners 36 for closing. The compartment 34 may be employed for containing money or a shopping list.

In use, bottles 24 are placed in the larger portions of the openings 18 by their neck portions 20, and are them urged towards the tapered ends of the racks 14 until the flanges 22 thereof, engage with the tops of the racks 14. The device 10 is then lifted by grasping the handle 26 in a hand of the user. For releasing the bottles 24 from the racks 14, the reverse of above is effected.

Referring now to FIG. 6, a modified rack 38 is provided with a plurality of teeth 40 in the openings 42, for better gripping of the bottles 24.

In use, racks 38 function in the same manner described of 14.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A bottle carrier device, comprising two beverage racks, each rack comprising in turn two bow shaped rails interconnected at their respective ends, a center member secured between each pair of rails, bottles being received in between each of said pairs of rails adjacent each of the ends whereby four bottles can be carried within said two racks, a handle secured between said center members for carrying said bottles, and an optional pocket provided in said handle for receiving money or the like.

2. A bottle carrier device as set forth in claim 1, wherein each said pair of rails are substantially parallel to each other and spaced-apart at their centers and said center member is fixedly secured in each rack, and an opening is defined in each said rack on each side of said center member which opening tapers towards said respective ends of each said rack, for removably receiving said beverage bottles.

3. A bottle carrier device as set forth in claim 2, wherein a neck of each bottle of said beverage bottles is received within the openings defined in each said rack, and when said neck is urged into a tapered end of said rack, said beverage bottle is then urged downward until an upper flange of said neck engages with a top surface of said rack, causing said beverage bottle to depend downward from the said rack, and said handle is flexible and is fixedly secured at each end to each said center member, by fasteners.

4. A bottle carrier device as set forth in claim 3, wherein said optional pocket provided in said handle, comprises a pair of overlapping flaps having fasteners fixedly secured to each one of said pair of flaps, and said fasteners when engaged, close said pocket, confining said money or grocery list.

* * * * *